US008550599B2

(12) United States Patent
Miyazaki et al.

(10) Patent No.: US 8,550,599 B2
(45) Date of Patent: Oct. 8, 2013

(54) LIQUID EJECTION HEAD AND PROCESS FOR PRODUCING THE SAME

(71) Applicant: Canon Kabushiki Kaisha, Tokyo (JP)

(72) Inventors: Hirotaka Miyazaki, Yokohama (JP); Toshiaki Kaneko, Tokyo (JP); Satoshi Kodama, Oita (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/688,526

(22) Filed: Nov. 29, 2012

(65) Prior Publication Data

US 2013/0155150 A1 Jun. 20, 2013

(30) Foreign Application Priority Data

Dec. 20, 2011 (JP) ..... 2011-278346

(51) Int. Cl.
*B41J 2/14* (2006.01)
*B41J 2/16* (2006.01)

(52) U.S. Cl.
USPC ..... 347/50; 347/67

(58) Field of Classification Search
USPC ..... 347/20, 40–44, 49–50, 58, 64, 84–86
See application file for complete search history.

(56) References Cited

U.S. PATENT DOCUMENTS 6,905,342 B2 * 6/2005 Swier et al. ..... 439/65
8,419,166 B2 * 4/2013 Tsukamoto ..... 347/50

FOREIGN PATENT DOCUMENTS

JP 2002-79675 A 3/2002

* cited by examiner

*Primary Examiner* — Thinh Nguyen
(74) *Attorney, Agent, or Firm* — Fitzpatrick, Cella, Harper & Scinto

(57) ABSTRACT

A process for producing a liquid ejection head including a recording element substrate, an electrical wiring substrate provided with plural lead terminals, a support member provided with a concavity and a joining surface, and a sealant control wall arranged between a side surface of the recording element substrate and a side surface of the support member, the process including preparing a liquid ejection head in which the concavity and recording element substrate are mutually fixed, the joining surface and electrical wiring substrate are mutually fixed, and the lead terminals and connection terminal are mutually connected, and filling the sealant between the side surface of the recording element substrate and the side surface of the sealant control wall on the side of the recording element substrate followed by filling the sealant between a side surface of the sealant control wall on the side of the lead terminals and the lead terminals.

15 Claims, 6 Drawing Sheets

FIG. 5A1
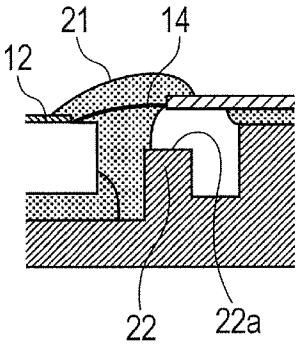
FIG. 5A2
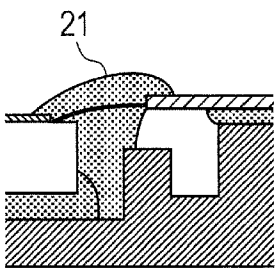
FIG. 5A3
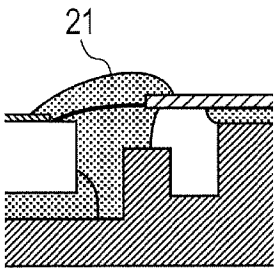
FIG. 5A4
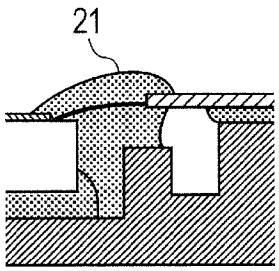
FIG. 5B1
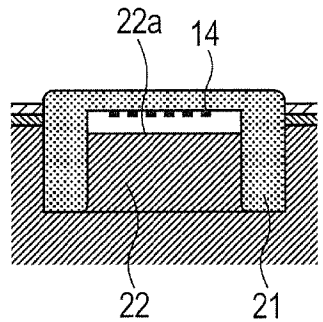
FIG. 5B2
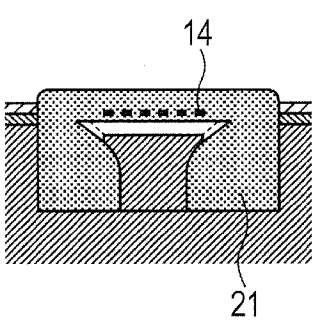
FIG. 5B3
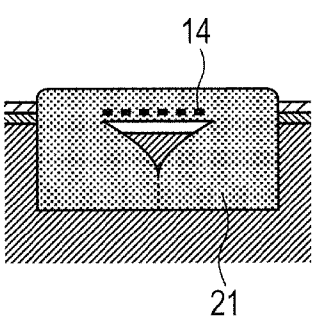
FIG. 5B4
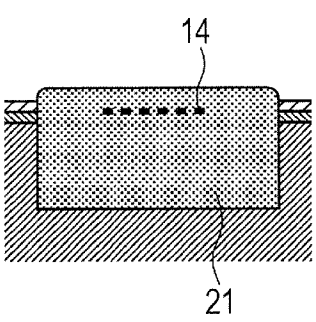

LIQUID EJECTION HEAD AND PROCESS FOR PRODUCING THE SAME

BACKGROUND OF THE INVENTION

1. Field of the Invention

The present invention relates to a liquid ejection head adapted to eject liquid such as ink through an ejection orifice as well as to a process for producing the liquid ejection head.

2. Description of the Related Art

Conventionally, a liquid ejection head used in a liquid ejection apparatus includes a recording element substrate in which an ejection orifice adapted to eject ink is formed, a support member adapted to hold and fix the recording element substrate, and an electrical wiring substrate provided with lead terminals connected to connection terminals of the recording element substrate.

A connecting portion between the connection terminals provided on the recording element substrate and the lead terminals extended from the electrical wiring substrate is sealed by being covered with a sealant to prevent faulty connections due to corrosion caused by ink and a broken wire caused by external forces. As a method for sealing the connecting portion, a method has been adapted which applies the sealant to tops of the lead terminals, causes the sealant to penetrate through between plural adjacent lead terminals, and thereby fills the sealant into bottom part of the lead terminals.

However, with this sealing method, it is difficult to fill the sealant into a space in the bottom part of the lead terminals by a single sealant application operation, and cavities or bubbles will be produced in the bottom part of the lead terminals, which can lead to seal failure. This makes it necessary to fill the sealant into bottom part of the lead terminals by dividing the sealant application operation into a few parts.

Thus, as a measure to deal with the seal failure described above, Japanese Patent Application Laid-Open No. 2002-079675 discloses a configuration in which a sealant catcher is provided in the bottom part of lead terminals. This configuration allows the sealant catcher to catch the sealant penetrating through gaps between plural adjacent lead terminals toward the bottom part of the lead terminals, ensures covering ability of the sealant near the lead terminals, and enables preventing faulty connections due to corrosion caused by ink or the like.

With the configuration described in Japanese Patent Application Laid-Open No. 2002-079675, in which the sealant catcher is provided in the bottom part of the lead terminals, although sealing is provided near the bottom part of the lead terminals, cavities or bubbles could be produced between the recording element substrate and sealant catcher.

When cavities or bubbles are produced between the recording element substrate and sealant catcher, in a production process before hardening the sealant, the bubbles might move to near the lead terminals due to vibrations produced when the liquid ejection head is conveyed. Also, when the liquid ejection head is put into a high-temperature environment to harden the sealant, the bubbles might expand and come close to the lead terminals, creating a danger that the bubbles will explode to damage the connecting portion.

Therefore, if the liquid ejection head needs to be conveyed before the sealant hardens, it is necessary to pay close attention to the vibrations transmitted to the liquid ejection head. Also, it is necessary to conduct visual inspection and the like to control bubble expansion during curing.

SUMMARY OF THE INVENTION

A process for producing a liquid ejection head according to the present invention comprises a recording element substrate for discharging a liquid, an electrical wiring substrate connected to a connection terminal of the recording element substrate and provided with a plurality of lead terminals for transmitting a signal for ejecting the liquid, a support member provided with a concavity for supporting the recording element substrate and a joining surface that is provided in an outer edge portion of the concavity and is joined to the electrical wiring substrate, and a sealant control wall that is arranged between a side surface on a side on which the connection terminal of the recording element substrate is provided and a side surface of the support member extending crosswise from an end portion on a side of the joining surface on which side the lead terminals are placed and extends along an arrangement direction of the plurality of lead terminals, the process comprising: preparing a liquid ejection head in which the concavity and the recording element substrate are fixed to each other, the joining surface and the electrical wiring substrate are fixed to each other, and the lead terminals and the connection terminal are connected with each other; and filling the sealant between the side surface of the recording element substrate and the side surface of the sealant control wall on the side of the recording element substrate followed by filling the sealant between a side surface of the sealant control wall on the side of the lead terminals and the lead terminals.

Also, a liquid ejection head according to the present invention comprises a recording element substrate for ejecting a liquid; an electrical wiring substrate connected to a connection terminal of the recording element substrate and provided with a plurality of lead terminals for transmitting a signal for ejecting the liquid; a support member provided with a concavity for supporting the recording element substrate and with a joining surface that is provided in an outer edge portion of the concavity and joined to the electrical wiring substrate; a sealant for covering a connecting portion between the connection terminal of the recording element substrate and the lead terminals; and a sealant control wall that is arranged between a side surface on a side on which the connection terminal of the recording element substrate is provided and a side surface of the support member extending crosswise from an end portion on a side of the joining surface on which side the lead terminals are arranged and extends along an arrangement direction of the plurality of lead terminals.

Further features of the present invention will become apparent from the following description of exemplary embodiments with reference to the attached drawings.

BRIEF DESCRIPTION OF THE DRAWINGS

FIGS. 5A1, 5A2, 5A3, 5A4, 5B1, 5B2, 5B3 and 5B4 are schematic sectional views (line 2-2 section and line 3-3 section in FIG. 1B) showing a flow of a sealant around the connecting portion between the connection terminals of the recording element substrate and lead terminals of the electrical wiring substrate.

DESCRIPTION OF THE EMBODIMENTS

Preferred embodiments of the present invention will now be described in detail in accordance with the accompanying drawings.

(First Embodiment)

Figure 1A:
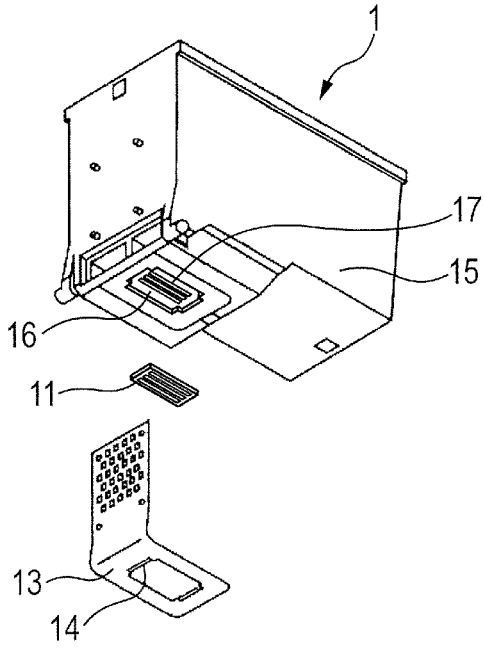
FIGS. 1A and 1B are perspective views showing a liquid ejection head according to a first embodiment.
Figure 1B:
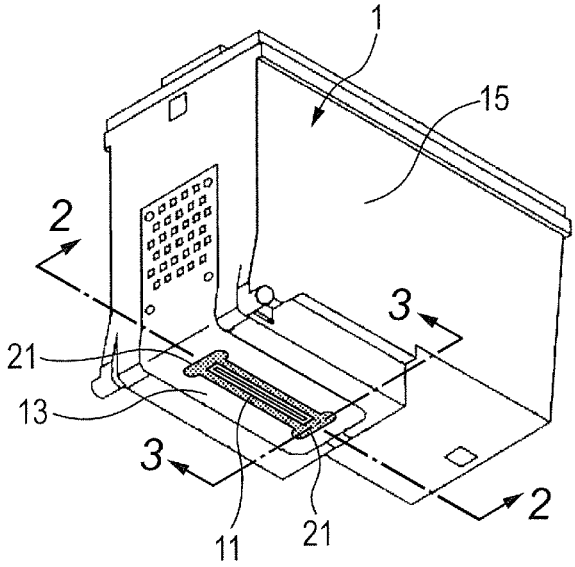

FIGS. 1A and 1B show perspective views of a liquid ejection head according to a first embodiment. As shown in FIGS. 1A and 1B, a liquid ejection head 1 (hereinafter referred to as a recording head 1) according to the first embodiment includes a recording element substrate 11 which includes plural energy generating elements for ejecting liquid such as ink. Also, the recording head 1 includes an electrical wiring substrate 13 serving as a wiring substrate connected to a connection terminal 12 of the recording element substrate 11 and provided with lead a terminal 14 for transmitting a drive signal and drive power for ejecting ink. Also, the recording head 1 includes a support member 15 which in turn includes a concavity 16 for supporting the recording element substrate 11, an ink flow path 17 provided in the concavity 16 for supplying ink to the recording element substrate 11, and a joining surface 18 that is provided in an outer edge portion of the concavity 16 and is joined to the electrical wiring substrate 13.

The recording element substrate 11 is a silicon substrate approximately 0.6 mm to 0.8 mm thick. Plural electrothermal converters used to eject ink and electrical wiring used to supply electrical power to the electrothermal converters are formed on one side of the recording element substrate 11 by film deposition technology. Furthermore, plural ink flow paths 17 and ejection orifices corresponding to the electrothermal converters are formed on the recording element substrate 11 by photolithography technology. Also, an ink supply path 19 used to supply ink to the plural ink flow paths 17 is formed so as to open to a back side.

The electrical wiring substrate 13 is intended to apply an electrical signal for ejecting ink to the recording element substrate 11 and is provided with a plurality of the lead terminals 14 respectively corresponding to the plural connection terminals 12 of the recording element substrate 11.

Figure 2:
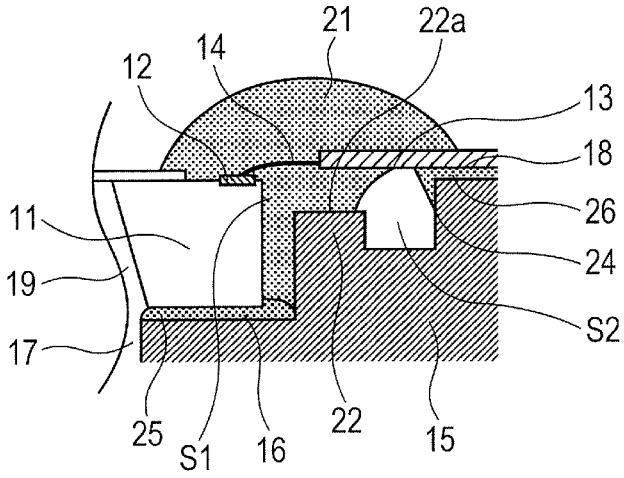
FIG. 2 is a schematic sectional view (line 2-2 section in FIG. 1B) showing a vicinity of a recording element substrate included in the liquid ejection head according to the first embodiment.
Figure 3:
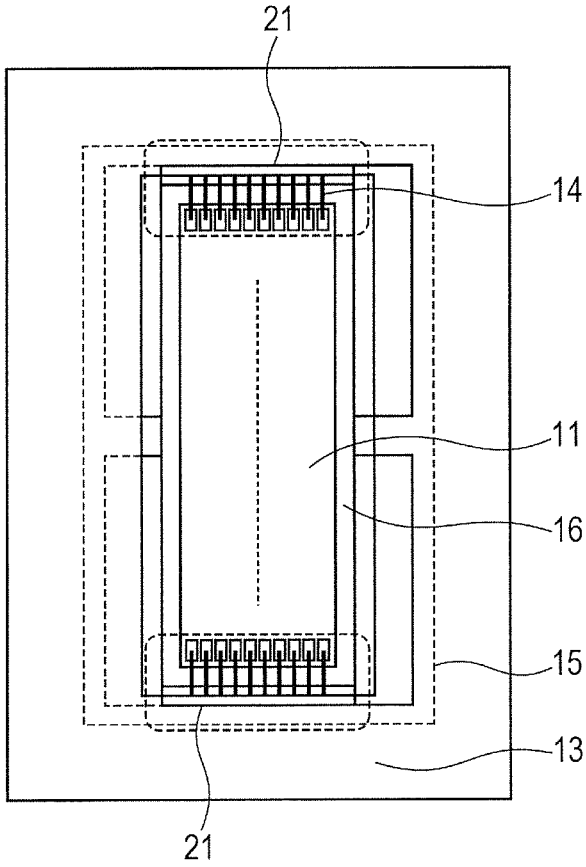
FIG. 3 is a schematic plan view (line 3-3 section in FIG. 1B) showing a vicinity of the recording element substrate included in the liquid ejection head according to the first embodiment.

FIG. 2 shows a schematic sectional view in the vicinity of the recording element substrate 11 included in the recording head 1 according to the first embodiment. FIG. 3 shows a schematic plan view (line 3-3 section) in the vicinity of the recording element substrate 11 included in the recording head 1 according to the first embodiment. The support member 15 will be described with reference to FIGS. 2 and 3.

The concavity 16, the ink flow paths 17 and a sealant control wall 22 are formed integrally to the support member 15, where the concavity 16 is used to fix the recording element substrate 11 and the sealant control wall 22 is adapted to control flow of a sealant 21 which is to cover a connecting portion between the connection terminal 12 and the lead terminal 14. However, the concavity 16 and sealant control wall 22 may be formed separately and then joined to the support member 15. Regarding material of the support member 15, resin material, ceramic material typified by $Al_2O_3$ and other material are widely available of use, and modified polyphenylene ether (modified PPE) is used in the present embodiment.

The sealant control wall 22 is located between a side surface on the side on which the connection terminal 12 of the recording element substrate 11 is provided and a side surface of the support member 15 extending crosswise from an end portion on that side of the joining surface on which the lead terminal 14 is placed. Also, the sealant control wall 22 extends along an arranging direction of the plural lead terminals 14 and has a function to separate a sealant-filled region S1 and a sealant-unfilled region S2 from each other, where the sealant-unfilled region S2 communicates with the atmosphere.

The sealant control wall 22 needs to be set to such a height that when the sealant 21 is applied to tops of the lead terminals 14, the sealant control wall 22 will not come into contact with the sealant 21 penetrating between the lead terminals 14 toward a back side of the lead terminals 14. Thus, desirably the sealant control wall 22 is set to a height lower than the height of the joining surface 18 of the electrical wiring substrate 13. When the sealant 21 is applied to the tops of the lead terminals 14, the amount of sealant penetrating through between the plural adjacent lead terminals 14 toward the back side of the lead terminals 14 depends on the width of the lead terminals 14, interval between the adjacent lead terminals 14 (distance between lead terminals), and viscosity of the sealant 21. The smaller the width of the lead terminals 14, or the larger the interval between lead terminals, or the lower the viscosity of the sealant 21, the larger the amount of sealant penetrating the back side of the lead terminals 14. Therefore, the height of the sealant control wall 22 needs to be set as appropriate.

According to the present embodiment, the width of the lead terminals 14 is set to 40 μm, the interval between the adjacent lead terminals is set to 80 μm, and a sealant 21 with a viscosity of approximately 50 to 80 Pa·s is used. Also, the height of the sealant control wall 22 is set to 0.5 mm and distance between the lead terminals 14 and an upper end 22*a* of the sealant control wall 22 is set to approximately 0.4 mm. As the sealant 21 described above, for example, a thermosetting sealant which has epoxy resin as its main constituent is used.

Next, a process for producing the recording head 1 will be described briefly.

First, the connection terminal 12 of the recording element substrate 11 and the lead terminal 14 of the electrical wiring substrate 13 are positioned in such a range that they can be interconnected and are electrically connected with each other by a TAB (Tape Automated Bonding) interconnection technique. Next, the recording element substrate 11 is joined to a predetermined location in the concavity 16 of the support member 15 using an adhesive 25, and the ink flow path 17 in the support member 15 and ink supply path 19 in the recording element substrate 11 are allowed to communicate with each other.

Next, the electrical wiring substrate 13 is similarly joined to a predetermined location (joining surface 18) on the support member 15 using an adhesive 26. Desirably the adhesives 25 and 26 used here have good ink resistance and, for example, thermosetting adhesives which have epoxy resin as their main constituent can be used. The adhesive 25 is applied to surroundings of the ink flow path 17 formed in the support member 15 and to the joining surface 18 of the electrical wiring substrate 13, and in applying the adhesive 25 to the surroundings of the ink flow paths 17, care should be exercised to apply the adhesive 25 in such a way as not to let the ink leak out through the ink supply path 19.

Finally, the sealant 21 is applied to the connecting portion between the connection terminal 12 of the recording element substrate 11 and the lead terminal 14 of the electrical wiring substrate 13 as well as to the concavity 16 located near both ends in an arrangement direction of the plural lead terminals 14, and the process is completed after curing.

Figure 4A:
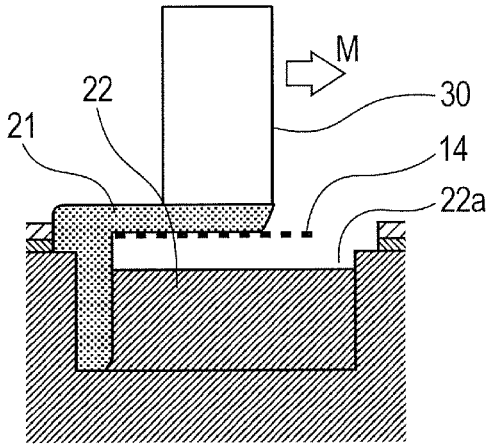
FIGS. 4A and 4B are a schematic sectional view (line 3-3 section in FIG. 1B) and schematic plan view showing a sealing process around a connecting portion between connection terminals of the recording element substrate and lead terminals of an electrical wiring substrate.
Figure 4B:
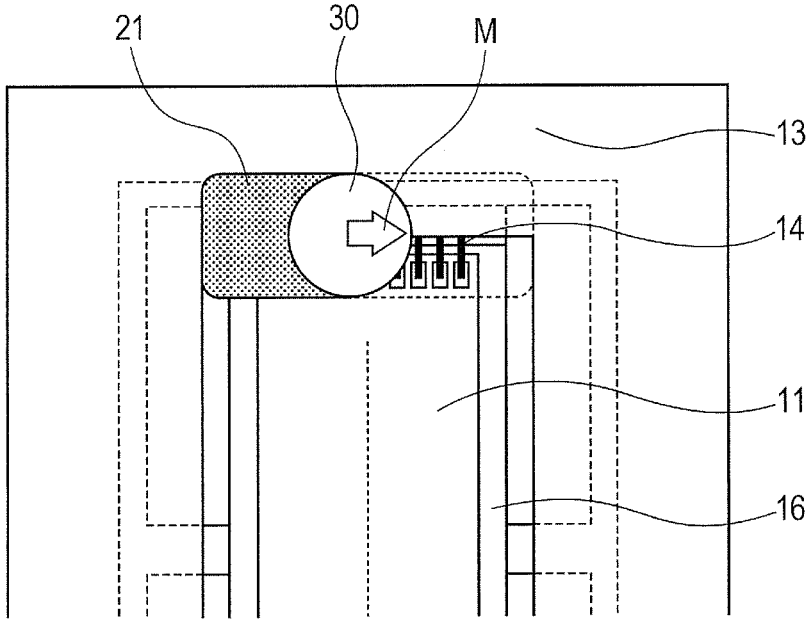

FIGS. 4A and 4B show schematic sectional view and schematic plan view illustrating the process of sealing in the vicinity of the connecting portion between the connection terminal 12 of the recording element substrate and the lead terminal 14 of the electrical wiring substrate 13. Regarding position of a needle 30 used to apply the sealant 21, the sealant 21 is applied by moving the needle 30 in a direction of the arrow M from an end portion in the arrangement direction of the plural lead terminals 14 toward an opposite end portion in the arrangement direction of the lead terminals 14 at a constant speed while maintaining a fixed height from top face of the electrical wiring substrate 13. Center position of the needle 30 is always located at a root of the electrical wiring substrate 13 and lead terminals 14.

Flow of the sealant 21 around the connecting portion between the connection terminal 12 of the recording element substrate 11 and the lead terminal 14 when applied as described above will be described with reference to FIGS. 5A1 to 5B4.

First, the sealant 21 is applied to the tops of the lead terminals 14 as well as to the vicinity of both ends in the arrangement direction of the plural lead terminals 14 in the concavity 16 (see FIGS. 5A1 and 5B1). Since the sealant 21 has a certain level of viscosity (50 to 80 Pa·s), it takes time for the sealant 21 to penetrate through between the lead terminals 14. Meanwhile, the sealant 21 applied near both ends in the arrangement direction of the plural lead terminals 14 penetrates between the recording element substrate 11 and sealant control wall 22 to fill the space therebetween with the sealant 21 (see FIGS. 5A2, 5A3, 5B2, and 5B3).

Finally, the air originally present is driven out to the opposite side of the sealant control wall 22 from the recording element substrate 11, and consequently the sealing is completed (see FIGS. 5A4 and 5B4). Incidentally, to reduce the time of completion of sealing, the flow of the sealant 21 may be facilitated by putting the sealant 21 in an environment with temperatures of approximately 40 to 70 degrees Celsius.

In this way, since the sealant control wall 22 is provided between an end portion of the recording element substrate 11 and a side surface of the concavity 16 of the support member 15, not only the vicinity of bottom part of the lead terminals 14 but also the entire bottom part of the lead terminals 14 can be filled easily with the sealant 21. Consequently, the present embodiment provides a highly reliable recording head 1 resistant to faulty connections due to corrosion caused by ink or breaking of wire caused by external forces.

(Second Embodiment)

Next, a recording head according to a second embodiment will be described. The second embodiment includes a support member which differs in shape from the support member 15 according to the first embodiment. Therefore, in the second embodiment, only the support member will be described. On the other hand, the same components and portions as those in the first embodiment are denoted by the same reference numerals as the corresponding components and portions in the first embodiment, and description thereof will be omitted.

Figure 6:
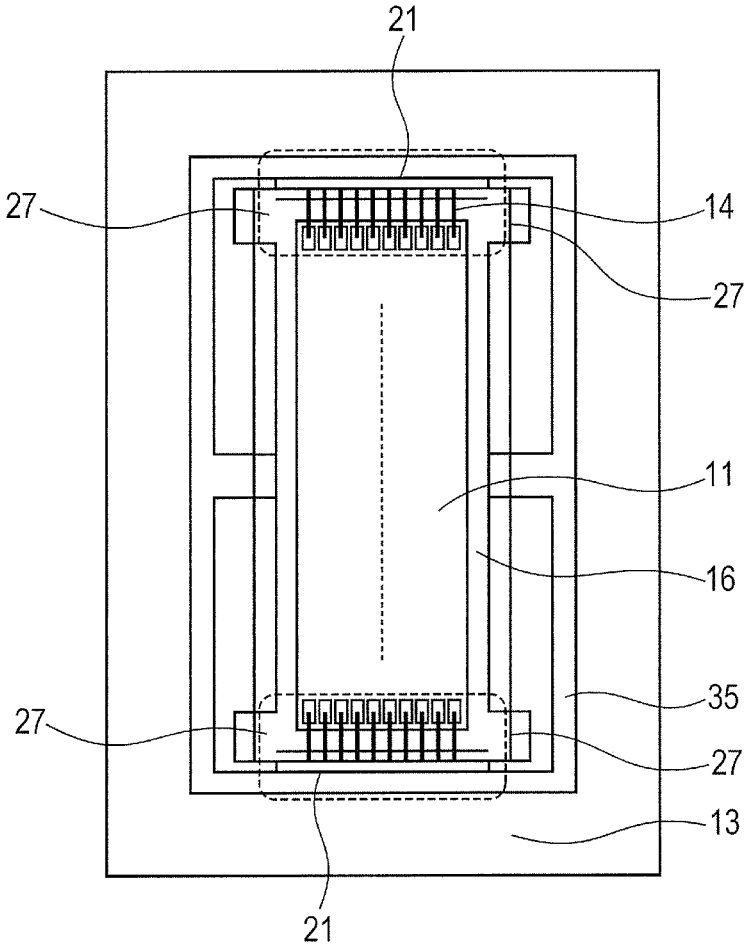
FIG. 6 is a schematic plan view (line 3-3 section in FIG. 1B) showing a vicinity of a recording element substrate included in a liquid ejection head according to a second embodiment.

FIG. 6 shows a schematic plan view in a vicinity of a recording element substrate 11 included in a recording head according to the second embodiment. As shown in FIG. 6, a support member 35 includes a concavity 16 for supporting and holding the recording element substrate 11, an ink flow path 17 for supplying ink to the recording element substrate 11, a sealant control wall 22, and a sealant storage portion 27 for storing the sealant 21, all of which are formed integrally. Regarding material of the support member 35, resin material, ceramic material typified by $Al_2O_3$ and other material are widely available of use, and modified PPE is used in the present embodiment.

The sealant control wall 22 is placed in bottom part of the lead terminals 14 between an inner surface 24 extending vertically downward from the joining surface 18 and an end portion of the recording element substrate 11 and is provided with a function to separate a sealant-filled region S1 and a sealant-unfilled region S2 from each other, where the sealant-unfilled region S2 is communicated with the atmosphere. The sealant control wall 22 needs to be set to such a height that when the sealant 21 is applied to tops of the lead terminals 14, the sealant control wall will not come into contact with the sealant 21 penetrating through between plural adjacent lead terminals 14 to the back side of the lead terminals 14. According to the present embodiment, the width of the lead terminals 14 is set to 40 μm, the interval between adjacent lead terminals is set to 80 μm, and a sealant 21 with a viscosity of approximately 50 to 80 Pa·s is used. Also, according to the present embodiment, the height of the sealant control wall 22 is set to 0.5 mm and the distance between the lead terminals 14 and an upper end 22*a* of the sealant control wall 22 is set to approximately 0.4 mm.

Also, there is a danger that before the sealant 21 applied near both ends in the arrangement direction of the lead terminals 14 is filled between an end portion of the recording element substrate 11 and the sealant control wall 22, the sealant 21 penetrating through between the lead terminals 14 to the back side of the lead terminals 14 will come into contact with the upper end 22*a* of the sealant control wall 22. If the applied sealant 21 comes into contact with the upper end 22*a* of the sealant control wall 22, bubbles produced vertically below the lead terminals 14 will lose their escape route. This is not desirable.

Figure 7A:
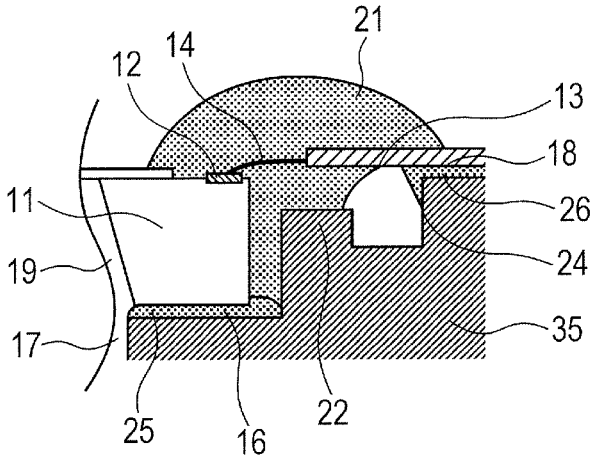
FIGS. 7A and 7B are schematic sectional views (line 2-2 section in FIG. 1B) showing an exemplary shape of a sealant control wall.

Thus, it is useful to cut off (C-chamfer) that corner of the upper end 22*a* of the sealant control wall 22 which is on the side of the recording element substrate 11 as shown in FIG. 7A.

Figure 7B:
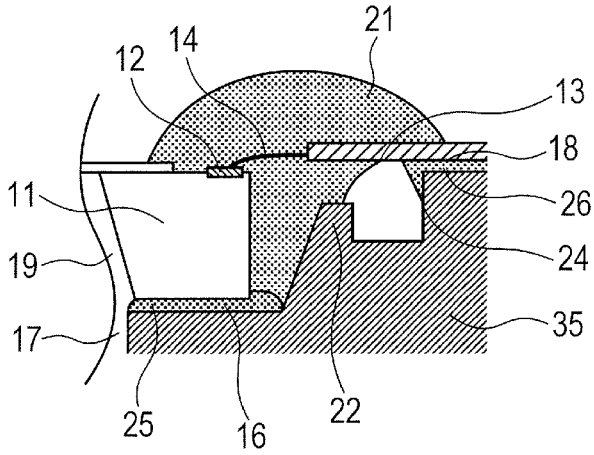

Alternatively, as shown in FIG. 7B, that side surface of the sealant control wall 22 which is located on the side of the recording element substrate 11 (recording-element-substrate side) may be formed so as to tilt such that the distance between the recording element substrate and sealant control wall 22 will increase gradually toward the side of the joining surface 18 (joining-surface side).

Figure 8:
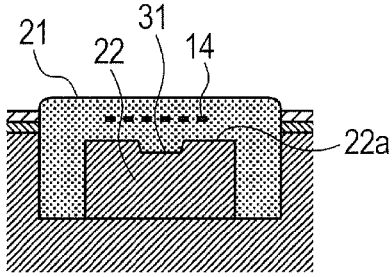
FIG. 8 is a schematic sectional view (line 3-3 section in FIG. 1B) showing an exemplary shape of the sealant control wall.

Furthermore, a groove 31, if provided in any desired location on the upper end 22*a* of the sealant control wall 22 as shown in FIG. 8, will provide the advantage of making it easy to drive out bubbles to the opposite side of the sealant control wall 22 to the recording element substrate 11 from between the recording element substrate 11 and the sealant control wall 22. The number and shape of grooves may be selected appropriately as required.

As the sealant 21 described above, for example, a thermosetting sealant which has epoxy resin as its main constituent is used. The sealant storage portion 27 is provided, on the support member 35, near both ends in the arrangement direction of the plural lead terminals 14 of the electrical wiring substrate 13 supported by the joining surface 18. When the connecting portion between the connection terminals 12 of the recording element substrate and the lead terminals 14 of the electrical wiring substrate 13 are sealed, the sealant storage portion 27 is filled with the sealant 21. Consequently, the weight of the sealant 21 filling the sealant storage portion 27 acts on the sealant 21 covering the connecting portion, reducing the time required for the sealant 21 to penetrate and fill between an end portion of the recording element substrate and the sealant control wall 22. Also, the shape according to the present embodiment is effectively applied when the recording element substrate 11 located below the lead terminals 14 connected to the connection terminals 12 has long side surfaces (along the arrangement direction of the lead terminals 14).

Next, regarding a process for producing a recording head according to the second embodiment, differences from the first embodiment will be described briefly. When the sealant storage portion 27 is provided at locations corresponding to opposite end portions in the arrangement direction of the plural lead terminals 14 as with the support member 35 according to the present embodiment, desirably the sealant storage portion 27 is provided smoothly with the sealant 21. As a method for filling the sealant storage portion 27 smoothly with the sealant 21, it is useful to control the movement of the needle 30 used to apply the sealant 21. For example, it is conceivable that the needle 30 is moved above the lead terminals 14 after halting the needle 30 above the sealant storage portions 27 for a certain time period to pour the sealant 21 into the sealant storage portions 27.

Although a so-called TAB circuit in which an electrical wiring substrate is provided with lead terminals has been described as an example in the above embodiments, the present invention is not limited to this. For example, the electrical wiring substrate and recording element substrate may be electrically connected via wiring wires by wire bonding.

In this way, in the support member 35 according to the present embodiment, the sealant control wall 22 is provided between an end portion of the recording element substrate 11 and a side surface of the concavity 16 of the support member 35 and moreover the sealant storage portion 27 is provided at opposite end portions in the arrangement direction of the plural lead terminals 14. Consequently, the present embodiment can accommodate various sizes of the recording element substrate 11 and reduce the time of completion of sealing. Besides, the present embodiment can further increase the reliability against faulty connections due to corrosion caused by ink or breaking of wire caused by external forces.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-278346, filed Dec. 22, 2011, which is hereby incorporated by reference herein in its entirety.

What is claimed is:

1. A process for producing a liquid ejection head that comprises a recording element substrate for discharging a liquid, an electrical wiring substrate connected to a connection terminal of the recording element substrate and provided with a plurality of lead terminals for transmitting a signal for ejecting the liquid, a support member provided with a concavity for supporting the recording element substrate and with a joining surface that is provided in an outer edge portion of the concavity and joined to the electrical wiring substrate, and a sealant control wall that is arranged between a side surface on a side on which the connection terminal of the recording element substrate is provided and a side surface of the support member extending crosswise from an end portion on a side of the joining surface on which side the lead terminals are arranged and extends along an arrangement direction of the plurality of lead terminals, the process comprising:

preparing the liquid ejection head in which the concavity and the recording element substrate are fixed to each other, the joining surface and the electrical wiring substrate are fixed to each other, and the lead terminals and the connection terminal are connected with each other; and filling a sealant between the side surface of the recording element substrate and the side surface of the sealant control wall on the side of the recording element substrate followed by filling the sealant between the lead terminals and that side surface of the sealant control wall which is located on a side of the lead terminals.

2. The process for producing a liquid ejection head according to claim 1, wherein the filling of the sealant between the side surface of the recording element substrate and the side surface of the sealant control wall on the side of the recording element substrate is performed by pouring the sealant from both ends of the sealant control wall toward a center.

3. The process for producing a liquid ejection head according to claim 1, wherein the filling of the sealant between the side surface of the recording element substrate and that side surface of the sealant control wall which is located on the side of the recording element substrate is performed through between the lead terminals.

4. The process for producing a liquid ejection head according to claim 1, wherein the support member includes a sealant storage portion provided in a vicinity of both ends in the arrangement direction of the plurality of lead terminals for storing the sealant; and the sealant is applied to tops of the lead terminals, both ends of the concavity in the arrangement direction of the plurality of lead terminals, and the sealant storage portion.

5. The process for producing a liquid ejection head according to claim 1, wherein the sealant is not filled between the sealant control wall and the side surface of the support member is not filled.

6. The process for producing a liquid ejection head according to claim 1, wherein an interval between the side surface of the recording element substrate and the sealant control wall is larger than a distance between the lead terminals that are adjacent.

7. A process for producing a liquid ejection head that comprises a recording element substrate for discharging a liquid, an electrical wiring substrate provided with a wiring for transmitting a signal for ejecting the liquid to the recording element substrate, a plurality of wiring wires for connecting a connection terminal of the recording element substrate and the wiring of the electrical wiring substrate, a support member provided with a concavity for supporting the recording element substrate and with a joining surface that is provided in an outer edge portion of the concavity and joined to the electrical wiring substrate, and a sealant control wall that is arranged between a side surface on a side on which the connection terminal of the recording element substrate is provided and a side surface of the support member extending crosswise from an end portion on a side of the joining surface on which side the wiring wires are arranged and extends along an arrangement direction of the plurality of wiring wires, the process comprising:

preparing the liquid ejection head in which the concavity and the recording element substrate are fixed to each other, the joining surface and the electrical wiring substrate are fixed to each other, and the wiring wires and the connection terminal are connected with each other; and filling a sealant between the side surface of the recording element substrate and a side surface of the sealant control wall on the side of the recording element substrate followed by filling the sealant between a side surface of the sealant control wall on the side of the wiring wires and the wiring wires.

8. The process for producing a liquid ejection head according to claim 7, wherein the filling of the sealant between the side surface of the recording element substrate and the side surface of the sealant control wall on the side of the recording element substrate is performed through between the wiring wires.

9. The process for producing a liquid ejection head according to claim 7, wherein an interval between the side surface of the recording element substrate and the sealant control wall is larger than a distance between adjacent wiring wires.

10. A liquid ejection head comprising:

a recording element substrate for discharging a liquid;

an electrical wiring substrate connected to a connection terminal of the recording element substrate and provided with a plurality of lead terminals for transmitting a signal for ejecting the liquid;

a support member provided with a concavity for supporting the recording element substrate and with a joining surface that is provided in an outer edge portion of the concavity and joined to the electrical wiring substrate;

a sealant for covering a connecting portion between the connection terminal of the recording element substrate and the lead terminals; and a sealant control wall that is arranged between a side surface on a side on which the connection terminal of the recording element substrate is provided and a side surface of the support member extending crosswise from an end portion on that side of the joining surface on which the lead terminals are arranged and extends along an arrangement direction of the plurality of lead terminals.

11. The liquid ejection head according to claim 10, wherein an upper end of the sealant control wall is lower than the joining surface.

12. The liquid ejection head according to claim 10, wherein the support member includes a sealant storage portion provided in a vicinity of both ends in the arrangement direction of the plurality of lead terminals.

13. The liquid ejection head according to claim 10, wherein a side surface of the sealant control wall on a side of the recording element substrate tilts such that a distance between the recording element substrate and the sealant control wall increases gradually toward the side of the joining surface.

14. The liquid ejection head according to claim 10, wherein the sealant is filled between the side surface of the recording element substrate and the sealant control wall; and there is a region not filled with the sealant between the sealant control wall and the side surface of the support member.

15. The liquid ejection head according to claim 10, wherein a distance between the side surface of the recording element substrate and the sealant control wall is larger than a distance between the lead terminals that are adjacent.

* * * * *